United States Patent [19]

Weaver

[11] 4,007,725

[45] Feb. 15, 1977

[54] ROTARY VALVING UNIT FOR AN INTERNAL COMBUSTION ENGINE

[76] Inventor: Robert R. Weaver, 1407 Manitou Drive, Santa Barbara, Calif. 93105

[22] Filed: Mar. 5, 1975

[21] Appl. No.: 555,543

[52] U.S. Cl. ..... 123/190 A; 123/80 BA;190 R

[51] Int. Cl.[2] ..... F01L 7/00

[58] Field of Search ..... 123/80 R, 80 BA, 190 R, 123/190 A, 190 BA

[56] References Cited

UNITED STATES PATENTS

| | | | |
|---|---|---|---|
| 1,146,782 | 7/1915 | Brower | 123/190 A |
| 1,347,919 | 7/1920 | Stokes | 123/80 BA |
| 1,578,111 | 3/1926 | Church | 123/190 A |
| 1,740,758 | 12/1929 | White | 123/190 A |
| 1,997,491 | 4/1935 | Kemp | 123/190 A |
| 2,799,258 | 7/1957 | Black | 123/190 A |
| 2,963,006 | 12/1960 | Harde | 123/190 A |

*Primary Examiner*—Wendell E. Burns
*Assistant Examiner*—David D. Reynolds
*Attorney, Agent, or Firm*—Jack C. Munro

[57] ABSTRACT

An internal combustion engine wherein a rotary inlet gaseous mixture valve is provided and a separate rotary exhaust valve. The inlet valve and the exhaust valve are connected together through a drive means and are rotated at the same velocity and in precise timing with respect to the engine crankshaft. The exhaust valve includes a water cooling jacket thereabout. The inlet valve includes an individual gaseous mixture inlet passage for each combustion chamber.

7 Claims, 11 Drawing Figures

ROTARY VALVING UNIT FOR AN INTERNAL COMBUSTION ENGINE

BACKGROUND OF THE INVENTION

The field of this invention relates primarily to improvements in the means for introducing the individualized charges of fuel into the different combustion cylinders of an engine and also to individualize removing of the exhaust gases from each of the combustion chambers of each cylinder.

The universally adopted poppet valve configuration for engines is inherently inefficient and also quite complex in construction. Inherently, a rotating valve system would be better than a reciprocating valve system, such as is incorporated in the poppet valves, but until the present time there has been no known usage of a rotary valve system.

SUMMARY OF THE INVENTION

For a summarial description of the subject matter of this invention, reference is to be had to The Abstract Of The Disclosure. For a more detailed description, reference is to be had to the following detailed description of the invention.

The main feature of the structure of this invention is to design a rotary valve system for an internal combustion engine which is simple in construction and efficient in operation. The valve system of this invention is designed to cause more complete burning of the fuel mixture and therefore emit less pollutants into the atmosphere. In physical appearance, the overall engine size is lower, more compact and less encumbered on its exterior. The rotary valve housing of this invention is approximately one half the height of a conventional poppet valve housing. The drive means for the rotary valve system of this invention is substantially more simple in construction than the cam and push rod assembly employed within the conventional poppet valve system.

DETAILED DESCRIPTION OF THE SHOWN EMBODIMENT

Figure 1:
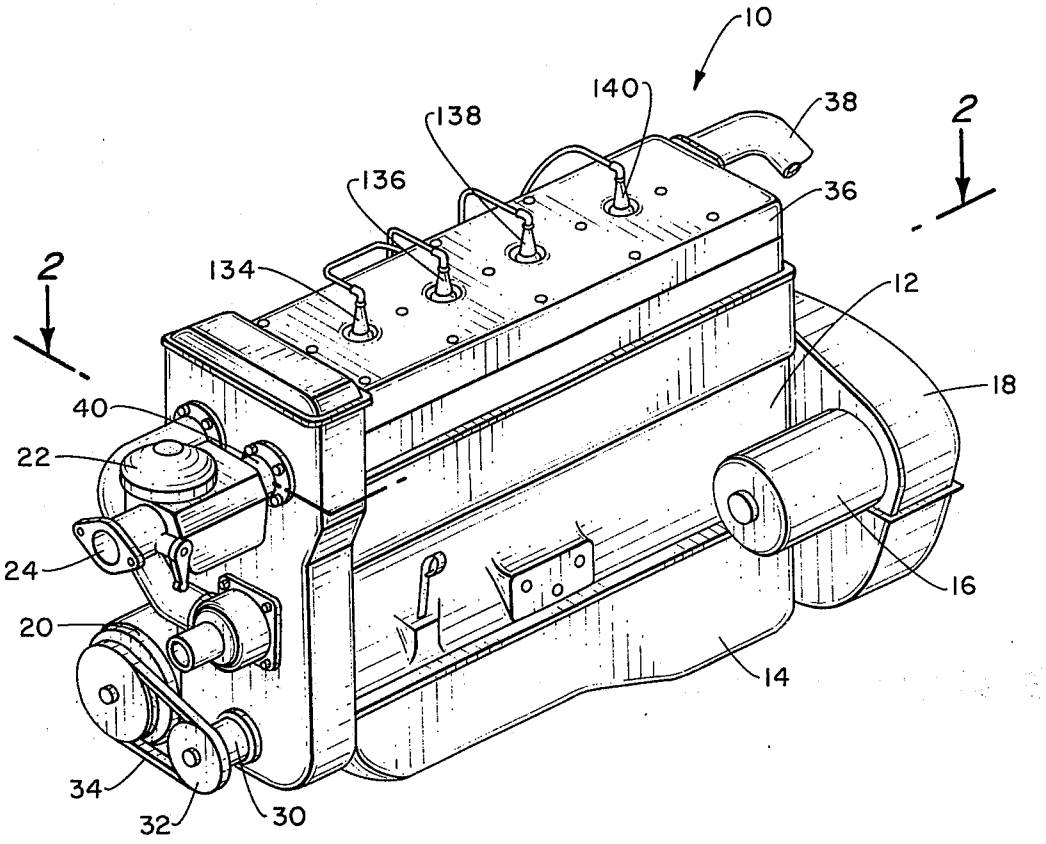
FIG. 1 is an isometric view of an engine upon which is employed the rotary valve system of this invention.

Referring particularly to FIG. 1 of the drawings, there is shown an internal combustion engine 10 which is constructed of the conventional parts of an engine block 12, an oil pan 14, a starter 16, a flywheel housing 18, a generator 20, a carburetor 22 and an air intake connection 24 connected to the carburetor 22. These parts are connected in the normal manner to an engine and it is not believed necessary to describe the basic operation of an internal combustion engine. Also conventionally employed within the engine block 12 are a series of cylinders 26 within which is movably mounted a piston 28. The engine 10 shown is a four cylinder engine with the cylinders in an in-line relationship. The particular engine shown is only for illustrative purposes and the structure of this invention could be readily applied to any engine structure.

The operation of the engine is well known and need not be discussed here in detail. The pistons 28 are connected to a crankshaft 30 which changes the reciprocating piston movement into a rotative source of power at the flywheel mounted within the flywheel housing 18. The forward end of the crankshaft 30 is connected to a crankshaft pulley 32 which through the belt 34 transmits rotative power to a generator 20.

The structure of this invention relates to a valving unit which is mounted within a housing 36. The function of the valving unit of this invention is to provide a mixture of fuel and air to each of the combustion chambers at the appropriate time and also to effect substantially complete removal of the burned exhaust gases after ignition. This is to be accomplished in a most efficient manner thereby maximizing the efficiency of the engine and also minimizing the emission of pollutants through the exhaust pipe 38 and into the ambient.

Air is to be supplied to the air intake 24 to the carburetor which in turn is mixed with vaporized fuel and is conducted into carburetor inlet manifold 40. The inlet manifold 40 is connected to a rotary inlet valve 42 which is low frictionally mounted in an appropriate sized opening formed within the housing 36. The housing 36 is formed of two parts, an upper part and a lower part which are interconnected together by bolts 44. The inlet valve 42 is rotatably mounted in a low frictional manner by means of roller bearings 46 and 48 mounted adjacent each end of the valve 42. The interior of the valve 42 is hollow and is formed into four separate chambers 50, 52, 54 and 56. The chambers are formed through the use of right angled divider plates 58 and 60. The divider plates 58 and 60 are fixedly secured, such as by welding to the interior wall of the rotary valve 42. Chamber 52 terminates by end plate 62 which terminates at the down stream end of the second cylinder 26. A similar divider plate is provided for the third cylinder 26 with end plate 64 terminating chamber 56 at the end of the last of the four cylinders. Downstream of each of the end plates is a dead passageway which has no function. However, in a high performance engine the mixture might enter at each end of the rotary valve so the dead passageway would then be usable. This would permit an increase (doubling in this instance) in the passage cross-sectional area.

Upstream of end plate 61 is an irregular shaped inlet opening 66. The opening 66 is somewhat rectangular in shape but actually is designed so as to achieve a maximum inlet area into its particular combustion chamber.

There is a similar irregular shaped opening for each combustion chamber with opening 68 being the only other such opening shown. Opening 68 is located adjacent end plate 64. For a four cylinder type of engine which is shown in the drawings, it is to be understood that there will be four separate inlet openings formed within the inlet valve 42. Each of the openings, such as openings 66 and 68, are arranged at a different angular position with respect to each other. In actual practice, the center of each of the openings will be approximately ninety degrees apart. A fuel mixture will be supplied to a combustion chamber every ninety degrees of rotation of the inlet valve 42. There is a similar identical shaped inlet port for each combustion chamber. These inlet ports are numbered 70, 72, 74, and 76 with port 70 being for the first combustion chamber and numeral 76 defining the inlet port for the last combustion chamber. Within FIG. 2 of the drawings the inlet opening 66 is positioned directly over the inlet port 70 defining the maximum open position.

The inner end of the inlet valve 42 is closed by a plug 78. Plug 78 is fixedly secured to the valve 42. The outer end of the plug 78 extends through the housing 36 and terminates in an access drive connection 80. The connection 80 is for the purpose of connecting to a fuel pump, a distributor, power steering pump or other types of structures located within a conventional vehicle.

The housing 36 includes appropriate cooling water passages 82. These passages 82 are adapted to receive water from the engine block 12 during operation of the engine.

Fixedly attached about the rotary valve 42 adjacent the inner end thereof is a drive gear 83. Gear 83 is fixedly secured to the rotary valve 42 by means of a screw fastener 84. The gear 83 is sized to rotate at half the speed of the crankshaft which is the same rotational speed characteristics of the conventional poppet valve engine. A rotational speed other than half crankshaft speed is possible if desired, by merely changing the size of the gear 83. This half speed arrangement is presently universally used and understood for valve gear operation on four cycle engines.

A cog belt 86 operatively connects with the drive gear 83. The cog belt also is connected to the crankshaft (not shown).

The cog belt 86 is also operatively connected to a gear 88. Gear 88 is fixedly secured by a bolt 90 to the exhaust valve 92. The gear 88 is the same size as gear 83. The exhaust valve 92 is basically in the same cylindrical configuration as the inlet valve 42 and is located substantially parallel to the inlet valve 42 and is horizontally spaced therefrom. The inner end of the exhaust valve 92 is closed by a plug 94. The outer end of exhaust valve 92 is connected to the exhaust pipe 38. The exhaust valve 92 is rotatably supported with respect to the housing 36 by means of roller bearings 96 and 98. It is to be noted that for both the exhaust valve 92 and the inlet valve 42 appropriate seals are provided where necessary.

The exhaust valve 92 includes a plurality of exhaust openings, such as opening 100 for cylinder number one, opening 102 for cylinder number three and opening 104 for cylinder number 4. The exhaust opening for cylinder number two is not shown. The interior of the exhaust valve 92 is divided into an elongated continuous chamber 106.

Adjacent opening 100 and attached to the inner wall of chamber 106 is a diverter plate 108. Similar diverter plates are provided for each exhaust opening and respectively for cylinders two, three and four (note diverter plates 110, 112 and 114). The function of the diverter plates is to prevent the exhaust from previous cylinders to have a tendency to pass in the reverse direction through the exhaust opening. As the exhaust enters the exhaust chamber 106, it is deflected by the diverter plate downstream. Also, the restriction of the exhaust gases at each exhaust opening causes a velocity increase of the exhaust gases and a syphoning action results which aids in extraction of the exhaust from the exhaust opening.

It is to be noted that the four exhaust openings are angularly displaced ninety degrees with respect to each other in the same manner as the inlet openings in the inlet valve 42. Also it is to be understood that there is a separate exhaust opening for each cylinder which has been previously discussed. There is a separate exhaust port providing access into each combustion chamber. The exhaust port is enlarged and irregularly shaped similar to the shape of each inlet port and also the exhaust opening is an identical configuration to each exhaust port. Only the exhaust port 116 is shown, but it is to be understood that there are similar exhaust ports for cylinders one, two and three.

Because of the high heat which the exhaust valve 92 will incur, a cooling water jacket 118 is included within the exhaust valve 92. The inner end of the outer wall of exhaust valve 92 is extended to form extension 120. A water inlet conduit 122 connects with water supply opening 124 of a cap 126. The cap 126 is fixedly secured to the extension 120, therefore, water is capable of being supplied through the conduit 122 through opening 124 and into cooling water jacket 118. A equiangular fin assembly 128 is provided adjacent opening 124 and is fixedly secured to the plug 94. As the exhaust valve 92 rotates, the fin members 128 function to propel the water into the cooling jacket 118 so there is a constant supply of cooling water being propelled through the jacket 118. At the outer end of the exhaust valve 92, the cooling jacket 118 communicates with annular chamber 130. Annular chamber 130 connects with a water outlet conduit 132. The water from conduit 132 will normally be conducted to a radiator or the like so as to be condensed and then resupplied back into the inlet conduit 122. It is to be noted that the gear 88 is fixedly secured upon the extension 120. In lieu of water cooling, an air cooling system may be employed.

Fixedly mounted within the housing 36 are a series of electrically activated spark plugs 134, 136, 138 and 140. Each of the spark plugs are basically identical and there is a single plug for each combustion chamber. The firing of each plug is accomplished through the distributor in the conventional manner and need not be discussed herein in detail.

The operation of the valving unit of this invention is as follows: During operation of the engine 10, a fuel air mixture is supplied from a carburetor through passage 40 into the rotary inlet valve 42. As the inlet valve 42 rotates, the individual inlet openings, such as openings 66 and 68, match with their respective inlet port, such as port 70, 72, 74 and 76. It is to be noted that the fuel air mixture is supplied to the individual passages such as 50, 52, 54 and 56. The individual port shape and opening area along with the rotary inlet valve port shape and opening are precisely designed in time to provide a controlled open inlet area and shape in relation to the piston location or movement during the intake stroke. The dimensions of such would vary with different engine size performance requirements in use. The inlet mixture will initially enter at the outboard edge of the cylinder as the valve rotates. During typical engine timing, this opening will occur as the exhaust rotary valve 92 is just closing for the particular cylinder. In other words, the exhaust opening 100 would be just closing as the inlet opening 66 is just beginning to open. Therefore, for just a few microseconds, both the intake openings and the exhaust opening for a given cylinder are both open and provide access into the combustion chamber. This is defined as the "overlap" and this aids in purging residual exhaust gases from the combustion chamber.

This "overlap" position is similar to conventional poppet valve engines except that the rotary valve unit of this invention is more efficient due to the rotating opening shapes and location. That is "a long narrow" "slit" type of opening at the intake and a similar but shorter type of opening at the exhaust results in a much short "overlap time" thus saving fuel and reducing pollutants.

In short, the operation of the valving unit of this invention requires that a fuel air mixture be supplied into each combustion chamber and such is fired by its respective spark plug resulting in power being applied to the piston 28 and then on the pistons return stroke the exhaust gases are expelled into the exhaust valve chamber 106 and out through the exhaust pipe 38.

The rotary valve unit of this invention is not subject to a inertial and structural consideration such as poppet valves and therefore open air versus time is only limited by matching the opening of the exhaust rotary valve 92 and the exhaust port into the cylinder which is quite large. A very rapid discharge of exhaust gases result.

It is to be noted that the spark plugs are installed at the center of the cylinder to assist in even burning of the combustion mixture. A conventional spark plug is employed.

Figure 2:
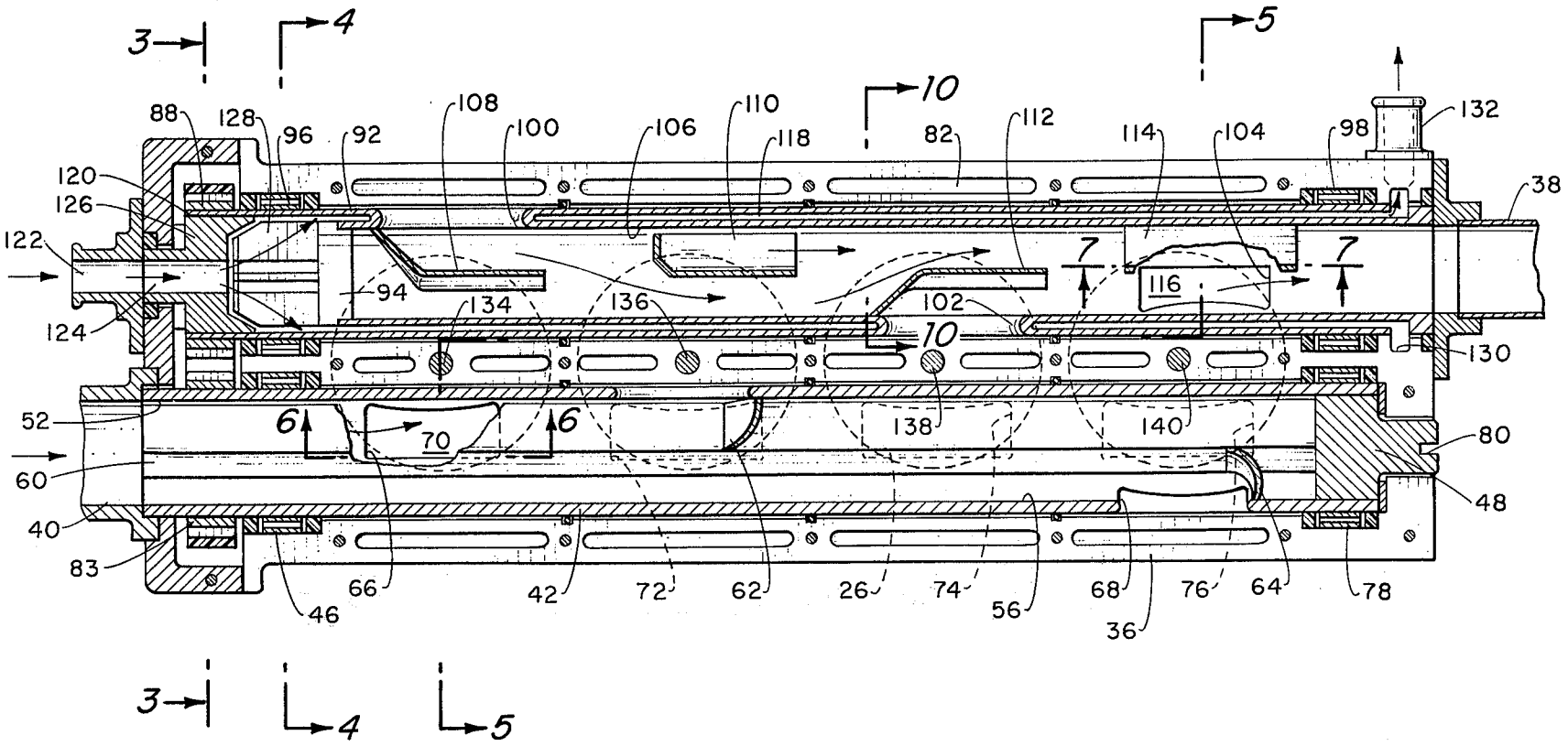
FIG. 2 is a cross-sectional view through the valve housing employed upon the engine of FIG. 1 taken along line 2—2 of FIG. 1.
Figure 3:
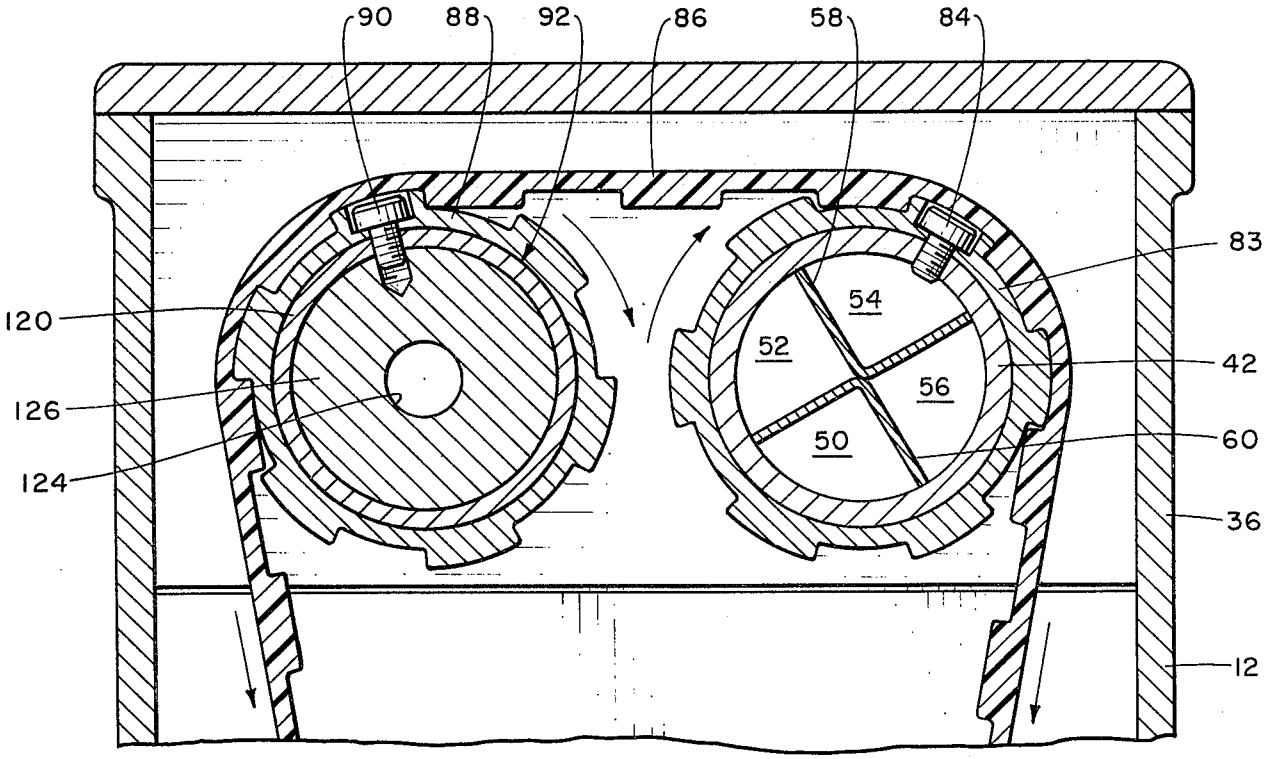
FIG. 3 is a cross-sectional view taken along line 3—3 of FIG. 2 showing in more detail the drive means employed to rotate the spaced apart rotary valves of this invention.
Figure 4:
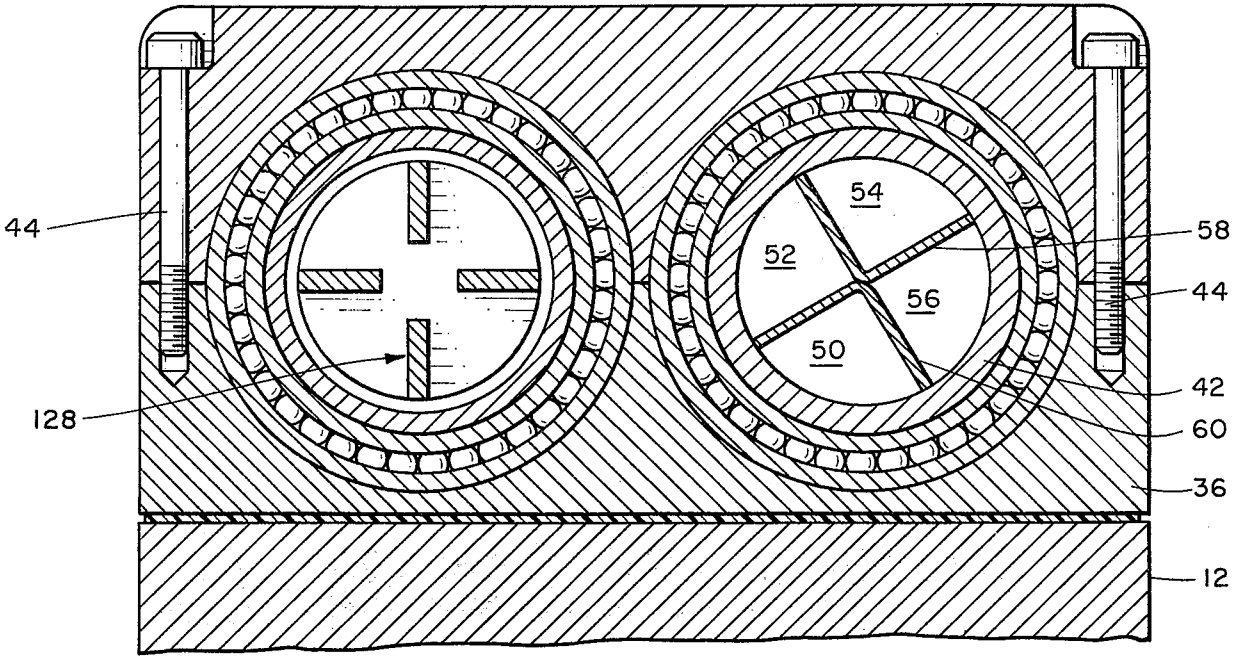
FIG. 4 is a cross-sectional view taken along line 4—4 of FIG. 2 showing in more detail the water pump assembly employed in conjunction with the exhaust rotary valve of this invention.
Figure 5:
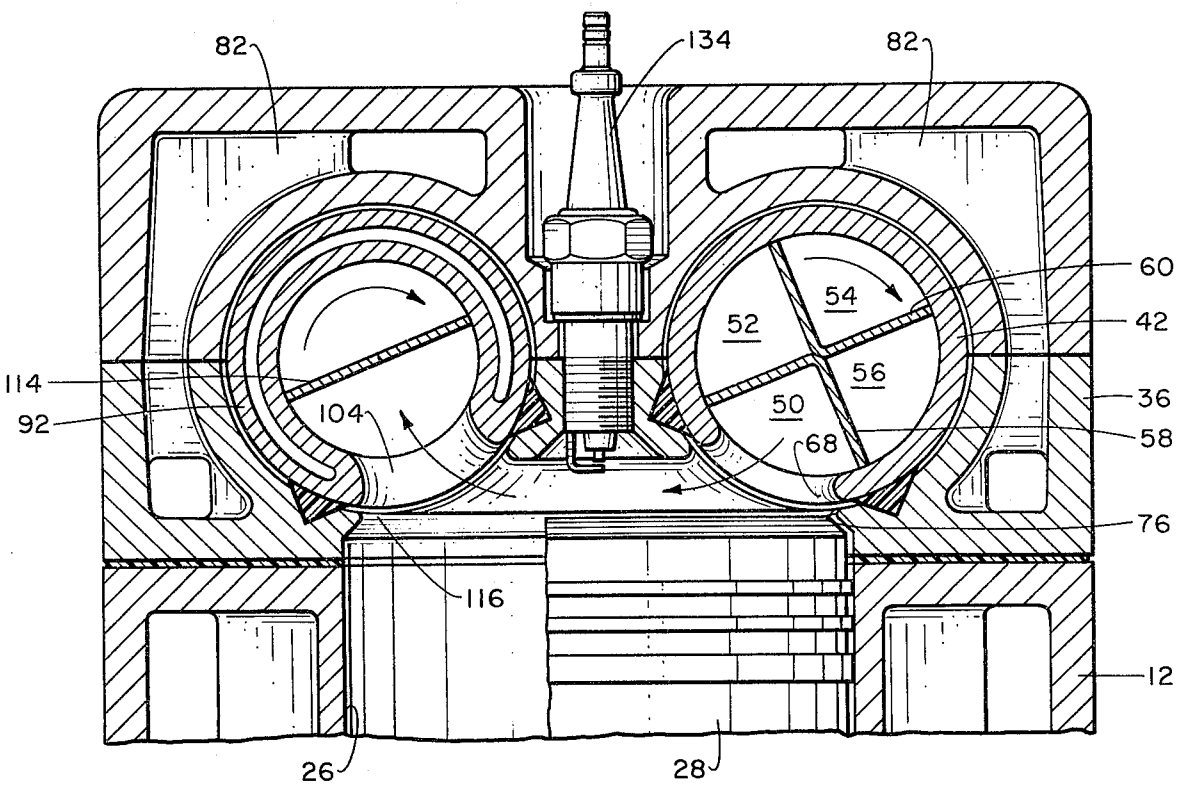
FIG. 5 is a cross-sectional view taken along 5—5 of FIG. 2 showing the rotary valves in conjunction with a spark plug to initiate combustion within the combustion chamber.
Figure 7:
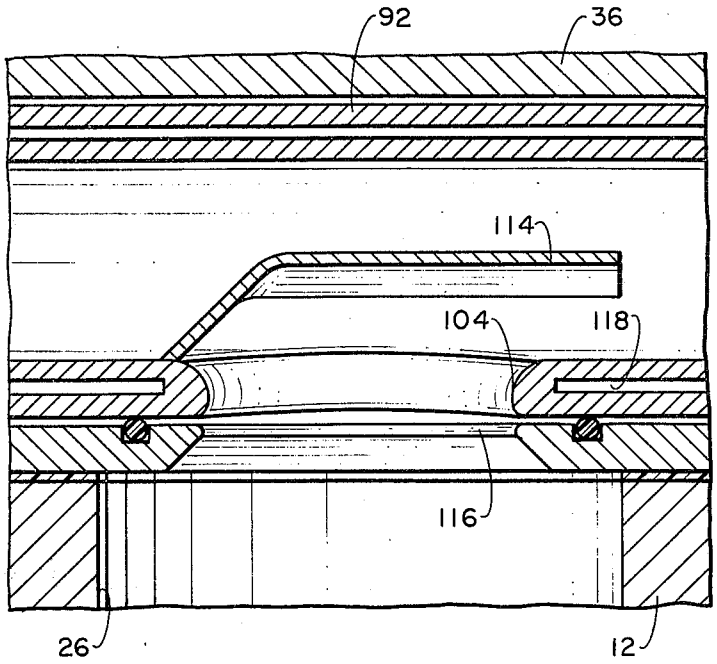
FIG. 7 is a cross-sectional view through a portion of the exhaust valve unit of this invention taken along line 7—7 of FIG. 2.
Figure 6:
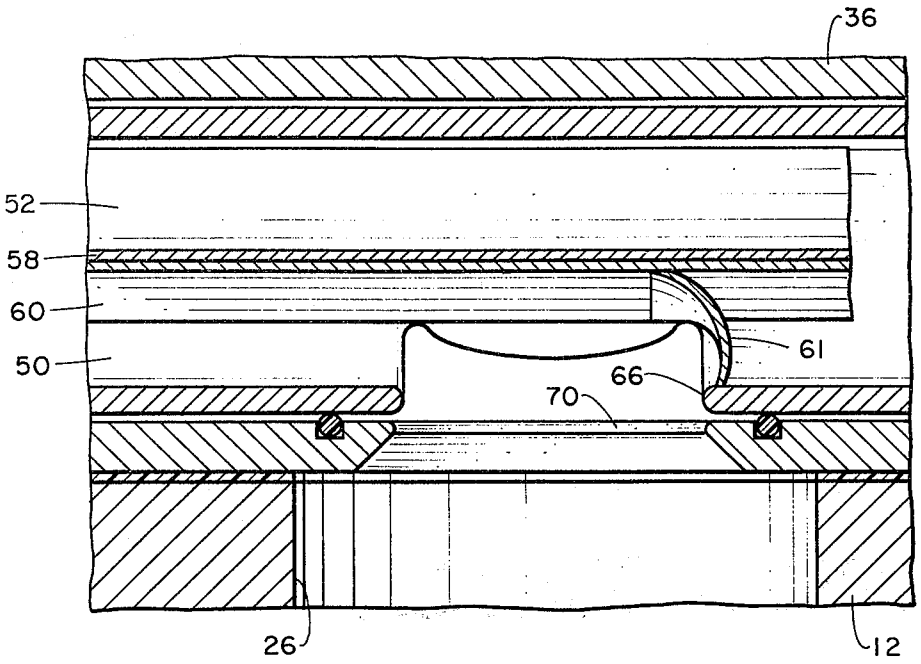
FIG. 6 is a cross-sectional view through a portion of the inlet valve unit of this invention taken along line 6—6 of FIG. 2.

Seals shown in particularly in FIG. 2 have not been discussed as they are deemed to be conventional. Lubrication of the seals may be required and in that instance a metered lubricant system would be used to apply a controlled amount of lubricant at specified seal area locations.

Figure 8:
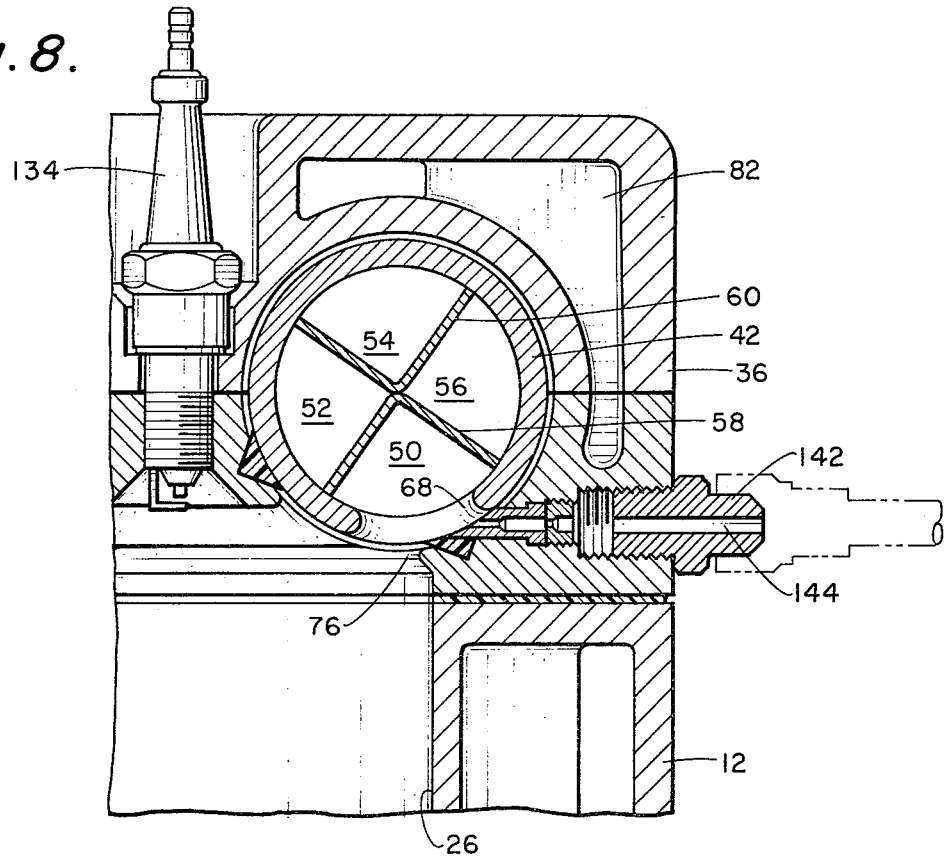
FIG. 8 is a partial view similar to FIG. 5 but of a modified form of structure employing a fuel injection system.

Referring in particularly to FIG. 8, a modified form of the valving unit is shown wherein a fuel injection system is employed. Timed direct port fuel injection is accomplished through a nozzle 142 extending through the housing 36 and connecting with each inlet opening of the rotary valve 42. There is to be a separate nozzle 142 for each inlet opening. The location of the nozzle 142 is so that the direct injection of the fuel is conducted through the inlet opening and directly into the combustion chamber. In other words, as the inlet valve 42 rotates, the inlet openings, such as opening 68 in FIG. 8, will communicate with both the passage 144 of the nozzle 142 and the inlet port 76 connecting into the combustion chamber. A valving system will normally be associated with each nozzle 142 to adjust fuel flow rates. The fuel flow is proportioned by a metering valve in relation to engine's feed and load. Through the individual passages 50, 52, 54 and 56, the air will be supplied to mix with the fuel supplied through each of the nozzles 142.

Figure 9:
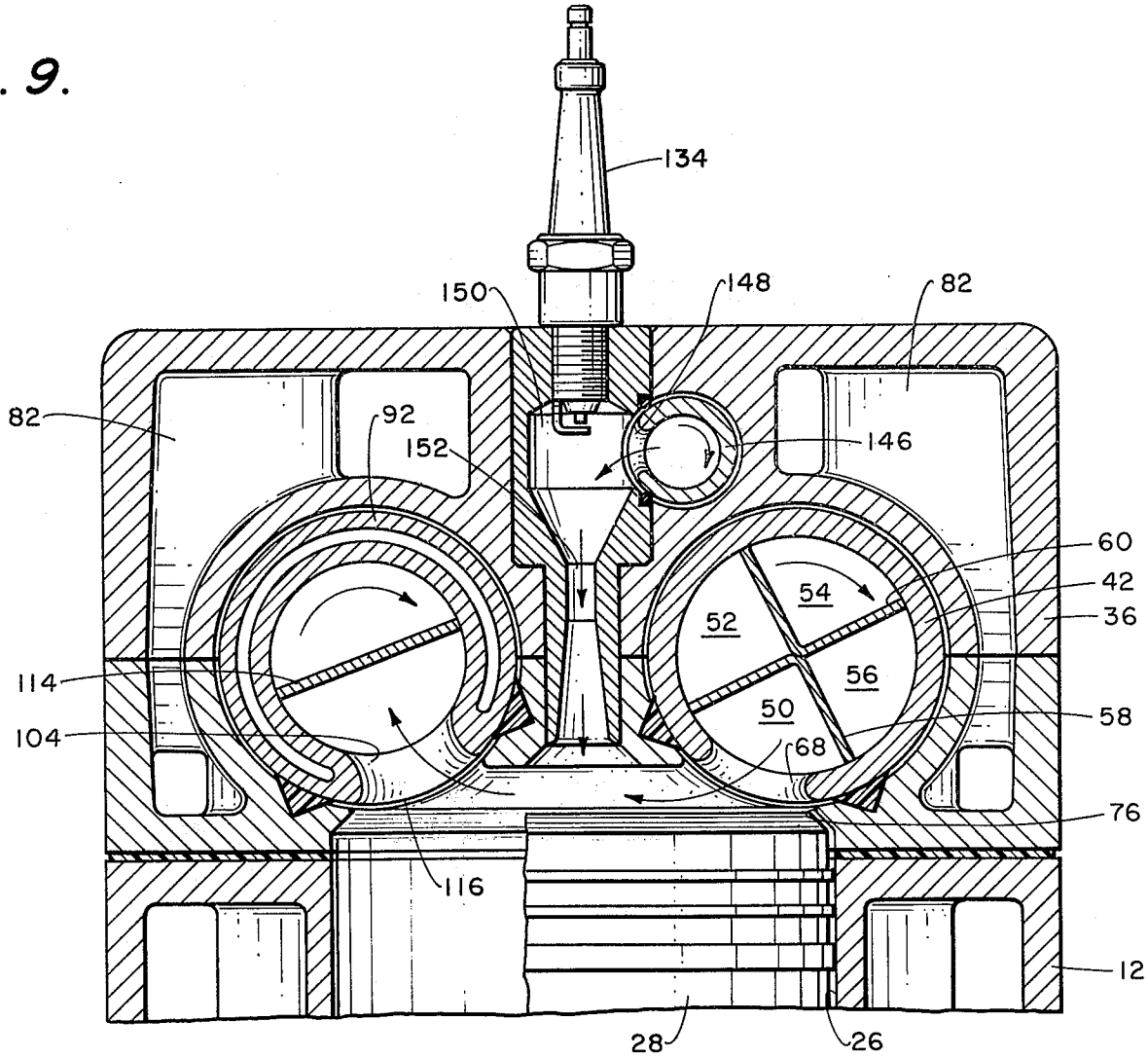
FIG. 9 is a view similar to FIG. 5 but showing a second modified form of this invention employing a precombustion chamber.

Referring in particular to FIG. 9 of the drawings, there is shown a second modified form of valving unit of this invention where a rich fuel mixture is ignited and conducted into the combustion chamber of each cylinder. Such precombustion of the fuel mixture prior to entering of piston combustion chamber may possibly decrease the amount of emissions and pullutants into the atmosphere and result in more even burning of the fuel and reducing fuel consumption by making combustion of lean mixtures possible. The fuel mixture is metered lean into the main combustion chamber and would be difficult to ignite except for the substantive combustion from the rich fuel mixture in the pre-combustion chamber.

A secondary rotary valve 146 is provided within the housing 36 and is arranged to supply a rich fuel mixture through inlet opening 148 into a precombustion chamber 150. The spark plug 134 connects to the chamber 150. There is a separate precombustion chamber 150 for each spark plug 134 and it is to be understood that the valving unit 146 will include appropriate openings, such as opening 148 for each precombustion chamber. Once the rich fuel mixture within the precombustion chamber 150 is ignited, the gases are expanded and forced through at high velocity a venturi 152 and into the combustion chamber of the engine. Into the combustion chamber of the engine through the inlet valve 42 is conducted a lean fuel air mixture. This lean fuel air mixture is ignited by the burning rich fuel air mixture which has been conducted from the precombustion chamber 150.

Figure 10:
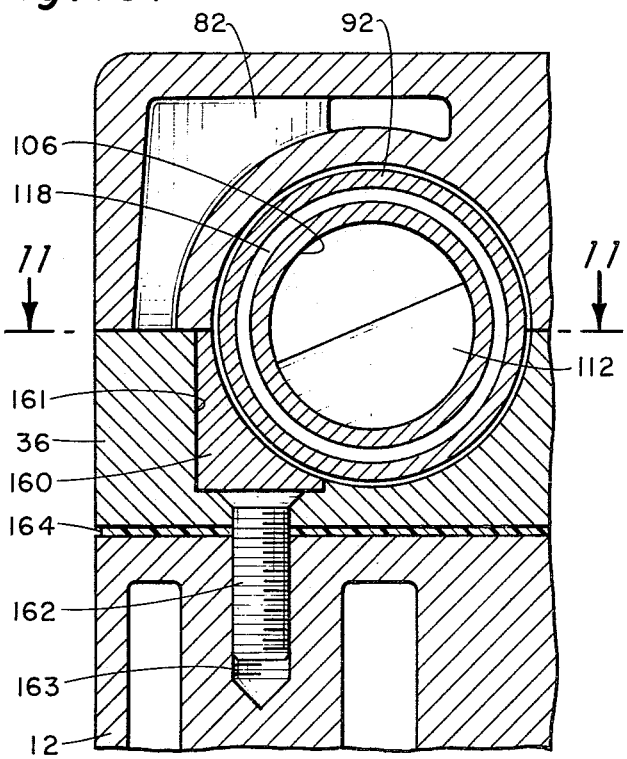
FIG. 10 is a cross-sectional view taken along line 10—10 of FIG. 2.
Figure 11:
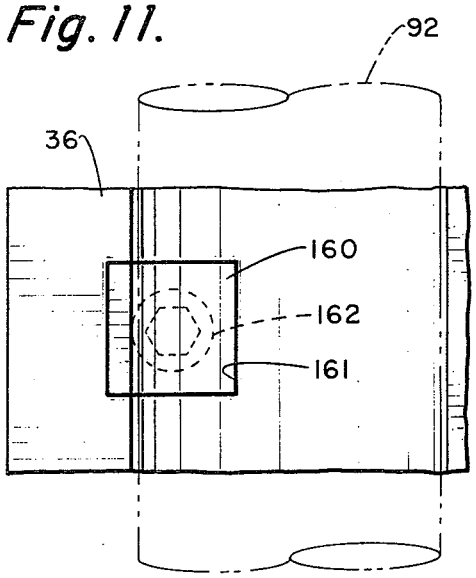
FIG. 11 is a segmental view taken along line 11—11 of FIG. 10.

Referring in particular to FIGS. 10 and 11 there is shown structure for connecting the housing 36 to the block 12. Threaded openings 163, located at spaced intervals, are formed within block 12. A threaded fastener 162 extends through an aperture in the housing 36 and connects with an opening 163. There will be a separate fastener 162 for each opening 163. A gasket 164 is positioned between block 12 and housing 36.

Each threaded fastener 162 connects with a separate recess 161. Positioned within each recess 161 is an insert 160. The insert 160 merely "floats" within its recess 161 (no attachment to the walls of the recess 161). There will be an insert 160 for each fastener 162 and for each recess 161.

What is claimed is:

1. In combination with an internal combustion engine, said engine including an engine block, said engine having a plurality of separate spaced apart chambers located within said block, an inlet port and a separate exhaust port formed within said engine block for each said combustion chamber, a piston movably mounted within each said combustion chamber, gases being adapted to ignite and expand within each said combustion chamber causing said piston to be forcibly moved, the improvement comprising:

a valving unit for supplying an ignitable gas mixture through said inlet port and for removing burned gases out through said exhaust port, said valving unit being mounted within a housing, said housing attached to said engine block, an inlet valve rotatably mounted within said housing, an exhaust valve rotatably mounted within said housing, both said inlet valve and said exhaust valve being cylindrical in configuration, said inlet valve having an interior inlet chamber being divided into a plurality of separate chambers with each said separate chamber connecting with a said combustion chamber inlet port through an inlet opening, each said separate chamber terminating just after its respective said inlet opening, said exhaust valve having a single interior exhaust chamber connecting with all said combustion chambers, said exhaust valve having a plurality of exhaust openings with each said exhaust opening connecting with a said exhaust port, both said inlet port and said exhaust port being non-circular in configuration and assuming an irregular shape resembling generally a rectangle to achieve even flow therethrough;

drive means interconnecting said exhaust valve and said inlet valve to rotate such in the same direction at the same rotational velocity, said drive means operates in conjunction with the speed of said engine so that the gases are supplied through said inlet ports at the appropriate instance and the exhaust gases are discharged at the appropriate instance through said exhaust ports.

2. The combination as defined in claim 1 wherein:

said inlet opening being substantially the same size as said inlet port, said exhaust opening being substantially the same size as said exhaust port.

3. The combination as defined in claim 1 including:

a cooling water jacket surrounding said exhaust valve, a water pump connected to said exhaust valve adapted to force water through said cooling jacket as said exhaust valve rotates.

4. The combination as defined in claim 1 wherein:

said drive means comprises a flexible belt.

5. The combination as defined in claim 1 wherein:

said interior exhaust chamber having a plurality of diverting plates, a said diverting plate mounted adjacent each said exhaust opening, each said diverting plate to restrict the flow of exhaust gases across it particular said exhaust opening to increase the velocity of gas flow thereacross to impart a syphoning action to the removal of the exhaust gases from its particular said exhaust opening.

6. The combination as defined in claim 1 wherein:

said drive means interconnecting said exhaust valve and said inlet valve in such a manner so that said inlet opening initiates communication with said inlet port with a portion of said exhaust opening still communicating with said exhaust port.

7. The combination as defined in claim 5 wherein:

said drive means interconnecting said exhaust valve and said inlet valve is such a manner so that said inlet opening initiates communication with said inlet port with a portion of said exhaust opening still communicating with said exhaust port.

* * * * *